US006765158B1

(12) United States Patent
Morrison et al.

(10) Patent No.: US 6,765,158 B1
(45) Date of Patent: Jul. 20, 2004

(54) LOW PROFILE SWITCH WITH FLAT WIRE HARNESS

(75) Inventors: Gerald O. Morrison, Beverly Hills, MI (US); Iris C. Drew, Berkley, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 10/431,800

(22) Filed: May 8, 2003

(51) Int. Cl.[7] ..... H01H 9/00

(52) U.S. Cl. ..... 200/5 R; 200/5 A; 200/341; 200/345

(58) Field of Search ..... 200/5 R, 5 A, 200/18, 17 R, 511, 512, 517, 341–345

(56) References Cited

U.S. PATENT DOCUMENTS

| | | | | | |
|---|---|---|---|---|---|
| 4,078,257 | A | * | 3/1978 | Bagley | 708/145 |
| 4,703,160 | A | * | 10/1987 | Narishima et al. | 235/1 D |
| 4,831,278 | A | | 5/1989 | Ueda et al. | 307/10.1 |
| 5,152,392 | A | * | 10/1992 | Iwasa | 200/517 |
| 5,187,647 | A | * | 2/1993 | Kaneko | 361/680 |
| 5,448,028 | A | * | 9/1995 | Filion et al. | 200/52 R |
| 5,514,843 | A | | 5/1996 | Wilfong et al. | 200/5 R |
| 5,612,692 | A | | 3/1997 | Dugas et al. | 341/22 |
| 5,878,489 | A | | 3/1999 | Shioda et al. | 29/57 |
| 5,950,808 | A | * | 9/1999 | Tanabe et al. | 200/314 |
| 6,137,072 | A | * | 10/2000 | Martter et al. | 200/512 |
| 6,259,044 | B1 | * | 7/2001 | Paratore et al. | 200/5 A |
| 6,371,548 | B1 | | 4/2002 | Misaras | 296/46.7 |
| 6,441,330 | B2 | * | 8/2002 | Liao | 200/515 |
| 6,483,048 | B1 | | 11/2002 | Bontrager et al. | 200/5 R |
| 6,528,742 | B2 | * | 3/2003 | Serizawa et al. | 200/5 R |
| 2002/0076975 | A1 | | 6/2002 | Sakai et al. | 439/495 |
| 2002/0094717 | A1 | | 7/2002 | Sakai et al. | 439/495 |
| 2002/0098733 | A1 | | 7/2002 | Okamura et al. | 439/483 |
| 2002/0153239 | A1 | | 10/2002 | Yoshida et al. | 200/520 |

* cited by examiner

*Primary Examiner*—Michael A. Friedhofer
(74) *Attorney, Agent, or Firm*—Bill C. Panagos

(57) ABSTRACT

A low profile modular switch, the switch including a switch plate including an actuator and a housing, and a sense plate including a switch mechanism configured to interface with the actuator, and a flat wiring harness having one end joined to the sense plate and another end having a connector, wherein tactile feel of the modular switch is determined by a property of the switch plate independent of the sense plate.

10 Claims, 5 Drawing Sheets

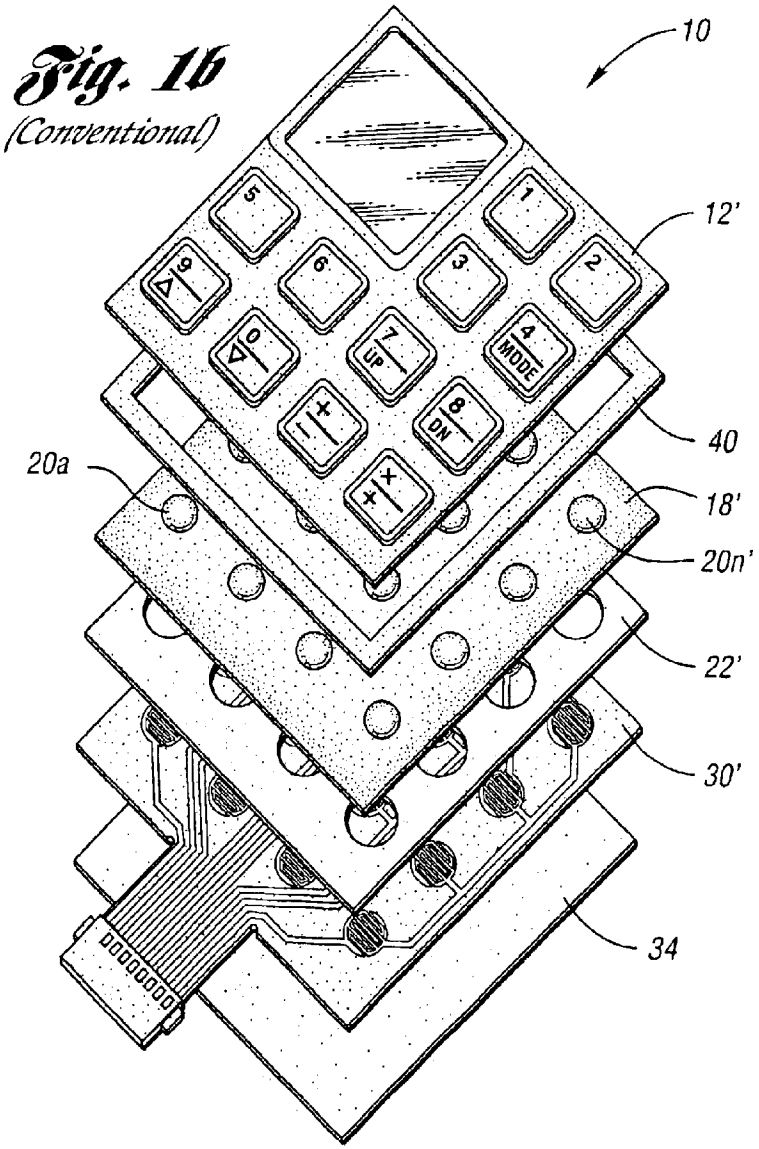
Fig. 1b
(Conventional)
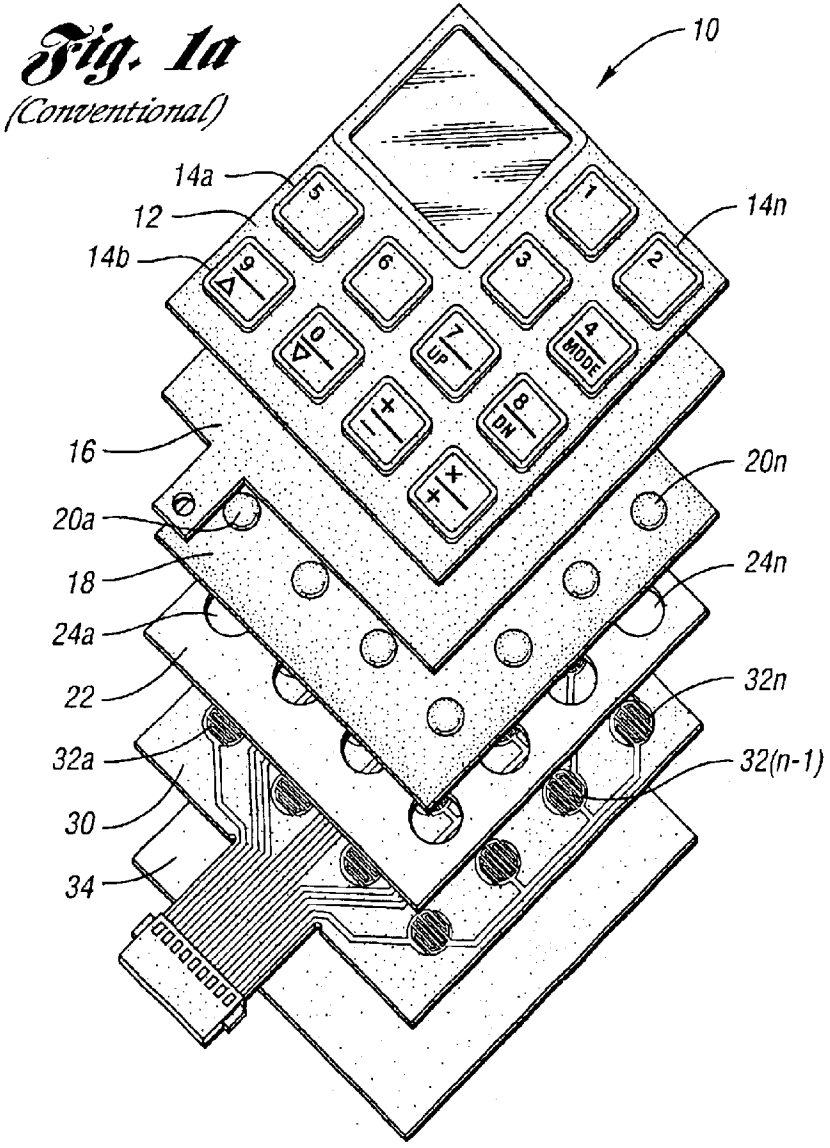
Fig. 1a
(Conventional)

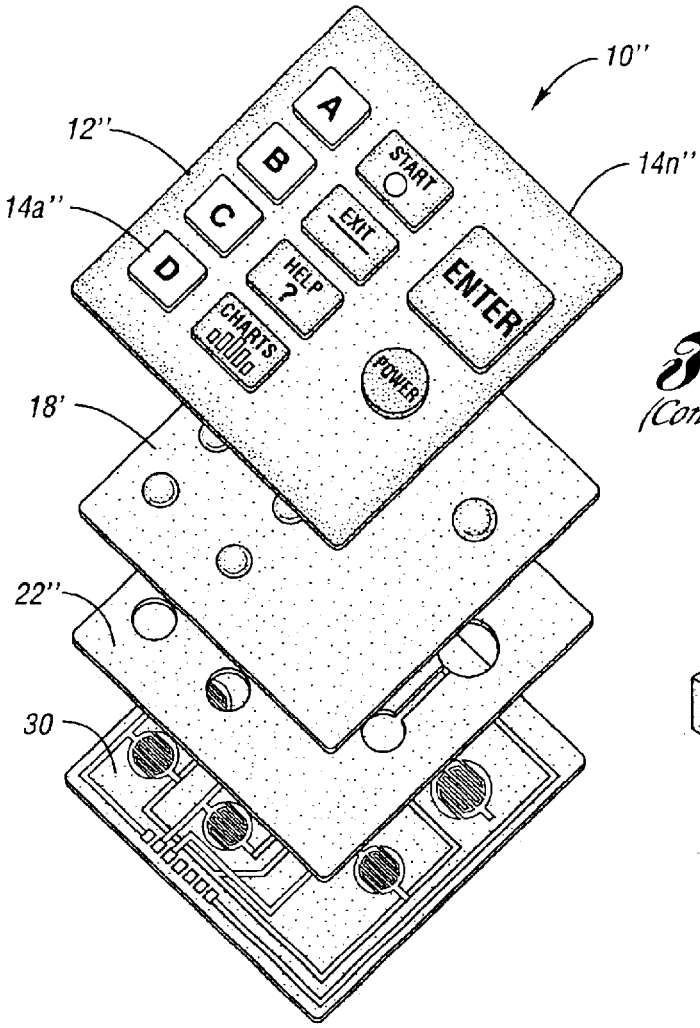
Fig. 1c
(Conventional)
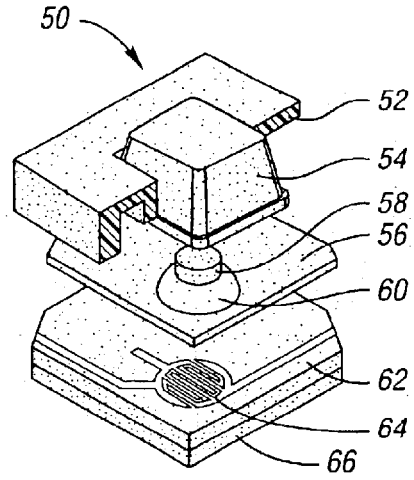
Fig. 2a
(Conventional)
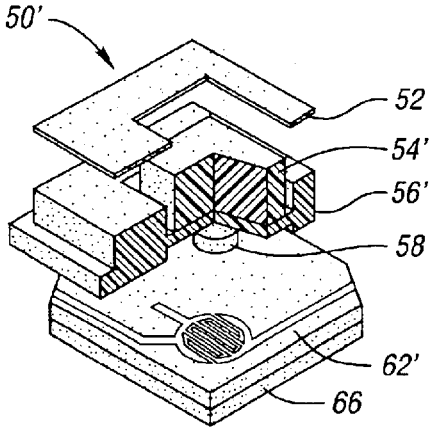
Fig. 2b
(Conventional)
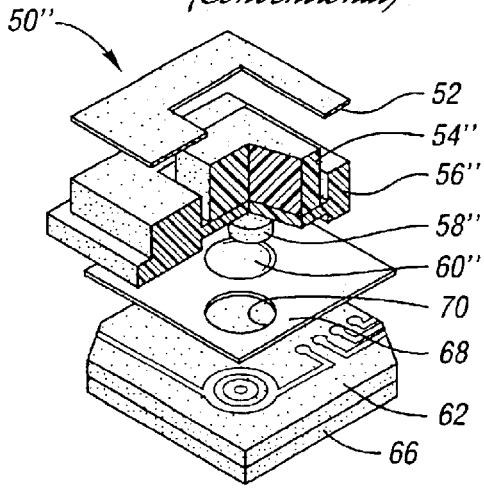
Fig. 2c
(Conventional)

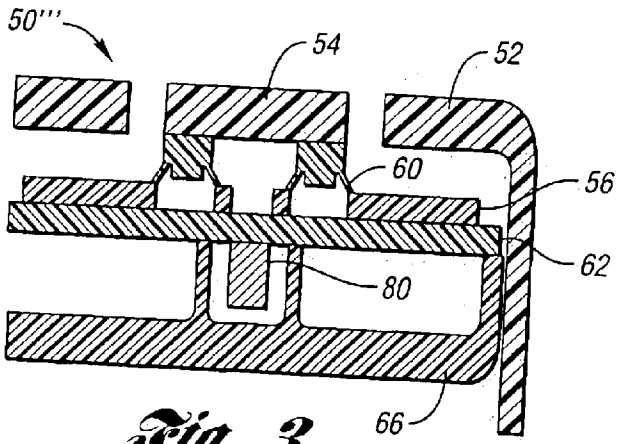
Fig. 3
(Conventional)

Fig. 6a
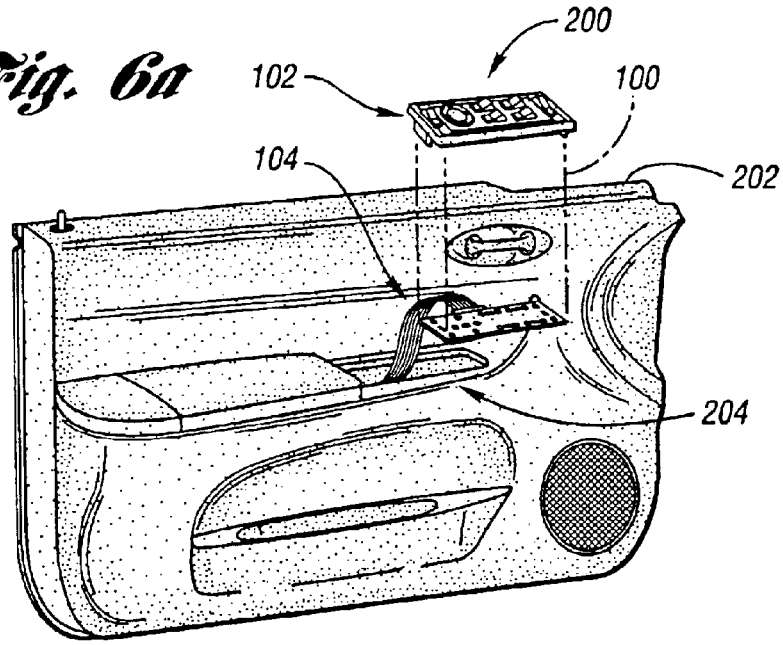
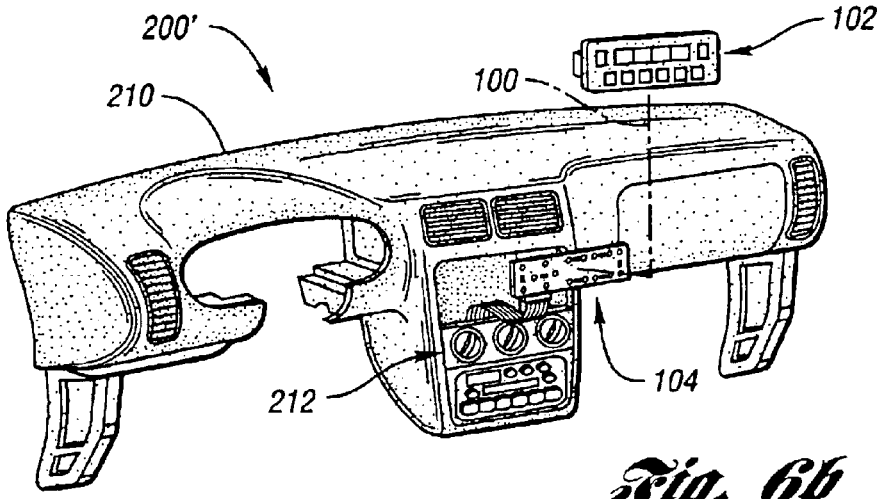
Fig. 6b
Fig. 6c
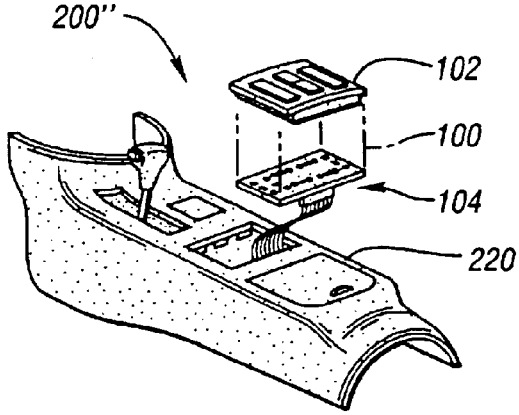

LOW PROFILE SWITCH WITH FLAT WIRE HARNESS

BACKGROUND OF THE INVENTION

1. Field of the Invention

The present invention relates to a system and a method for a low profile switch with a flat wire harness.

2. Background Art

Referring to FIG. 1*a*, a diagram 10 illustrating a conventional switch bank (or array) is shown. The switch bank 10 is a stacked (i.e., overlaid) structure. The switch back 10 is implemented to carry a low voltage DC signal. The switch bank 10 is a group of normally open, single pole, single throw (NO, SP, ST) momentary contact device non-tactile switches. The switch bank 10 includes a graphic overlay 12 having painted or printed on symbols 14*a*–14*n* that relate to numbers, arithmetic operators, and the like depending on the switch bank 10 application. In one example, the overlay 12 is disposed over an electrostatic discharge (ESD)/electromagnetic interference (EMI) shield 16. In another example, the overlay 12 is disposed directly over a top membrane 18. The membrane 18 has a number of contacts 20*a*–20*n* that align with the respective symbols 14*a*–14*n* when the switch bank 10 is properly assembled.

The switch bank 10 further includes a spacer 22 disposed under the membrane 18. The spacer 22 has holes 24*a*–24*n* that generally align with respective contacts 20*a*–20*n* in membrane 18. A bottom membrane (or circuit board) 30 includes circuit grids 32*a*–32*n* that generally align with respective contacts 20*a*–20*n* such that a respective circuit is closed when a user sufficiently depresses the respective symbol 14. The switch bank 10 can also include a subpanel (i.e., substrate, back cover, etc.) 34 that generally provides physical support. The stackup or overlay of the respective symbol 14, contact 20, hole 24, and grid 32 forms an individual switch in the switch bank 10.

The conventional switch bank 10 has a number of deficiencies that include when the switch bank 10 is manufactured the layers (i.e., the overlay 12, the membrane 18, the spacer 22, the circuit board 30, and the subpanel 34) can be difficult to align such that the respective symbols, holes, and circuits align properly, the switch bank 10 is not lighted or backlit, the overlay 12 and the symbols 14 are not registered (i.e., the surface of the overlay 12 is substantially smooth such that a user can not readily discern switch location and type by feel), and the switch bank 10 does not provide tactile feedback feel to the user.

However, the user generally prefers switches that have a tactile feel such that actuation of the switch provides positive feedback such as a snap to indicate switch operation. A tactile switch can be defined (e.g., by American Society for Testing and Materials standards ASTM F 1570–01e1 and F 1997–99) as a switch having a tactile ratio greater than zero. Furthermore, tactile indication of the respective switch symbol and/or switch lighting is desirable in many applications such that the user can readily identify the appropriate switch in a low light environment.

Referring to FIG. 1*b*, a diagram illustrating a conventional switch bank 10' is shown. The conventional switch bank 10' is similar to the switch bank 10. To provide a tactile feel, the switch bank 10' includes a spacer 40 disposed between the overlay 12 and a membrane 18'. The membrane 18' implements domes 20*a*'–20*n*' instead of the membrane contacts 20*a*–20*n* of switch bank 10. Depressing the membrane 12 at a symbol 14 of the switch bank 10' collapses a respective dome 20' to provide the tactile response to the user. However, the conventional switch bank 10' has a number of deficiencies. During manufacturing the layers can be difficult to align such that the respective symbols, domes, holes, and circuits align properly. The switch bank 10' is not lighted, and the overlay 12 and the symbols 14 do not provide tactile registration.

Referring to FIG. 1*c*, a diagram illustrating a conventional switch bank 10" is shown. The switch bank 10" is implemented similarly to the switch banks 10 and 10'. To provide a tactile feel switch bank, the switch bank 10" has a non-tactile overlay 12" made of an elastomer rubber having raised symbols 14" (i.e., buttons) to provide the tactile registration. The membrane 18' can provide a limited tactile feel. The switch bank 10" also substitutes an adhesive spacer 22" for the spacer 22. However, during manufacturing the layers can be difficult to align such that the respective symbols, domes, holes, and circuits align properly. The switch bank 10" is not lighted, and the tactile feel provided by the membrane 18' is reduced by the relatively thick and soft buttons 14".

Referring to FIG. 2*a*, a diagram illustrating an exploded, sectional view of a conventional switch (or cell) 50 is shown. A number of the switches 50 may be integrated (i.e., combined or implemented as an array) to provide a switch bank similar to the switch banks 10, 10', and 10". The switch 50 includes an overlay/bezel 52 with a hole that has a shape similar to a key top (or cap) 54. The key top 54 is hard plastic and protrudes through the bezel 52 and the bezel 52 generally positions the key top 54. The key top 54 is disposed onto a rubber keypad 56 that has a carbon or metallic pill (or puck) 58 on top of a dome 60. The dome 60 is disposed above a bottom membrane (or circuit board) 62 that has a circuit grid 64. The switch 50 may be disposed on a subpanel (i.e., substrate, back cover, etc.) 66 that provides physical support. To actuate the switch 50, the user depresses the key top 54, the key top 54 collapses the dome 60, and the pill 58 contacts the grid 64 to complete a circuit. The dome 60 provides tactile feel to the switch 50, however, the tactile feel is limited by the interface between the cap 54 and the pill 58.

The conventional switch bank 50 is not sealed at the interface between the bezel 52 and the key top 54 and debris can enter the interface and interfere with proper switch operation. During manufacturing the layers (i.e., the bezel 52, the key top 54, the keypad 56, and the membrane 62) can be difficult to align (i.e., gaps can be difficult to control) such that the respective key tops, domes, and circuits align properly, and the switch 50 is not lighted. Each key top 54 is typically individually molded, painted and assembled into the switch 50 assembly.

The alignment of the bezel 52 and the key top 54 is critical to the proper operation and feel of the switch 50. When the gaps between the bezel 52 and the key top 54 are not properly sized or aligned the key tops 54 can be too tight and bind, too loose and wobble and result in reduction or loss of tactile feel, and in any case fail to cause the pill 58 to properly contact the grid 64.

Referring to FIG. 2*b*, a diagram illustrating a conventional switch (or cell) 50' is shown. The switch 50' is implemented similarly to the switch 50. The switch 50' includes a tactile rubber keypad 56' having a formed key 54' that protrudes through the bezel 52. The pill 58 is fixed to the underside of the key 54'. The conventional switch bank 50' has similar deficiencies to the switch 50.

Referring to FIG. 2*c*, a diagram illustrating a conventional switch (or cell) 50" is shown. The switch 50" is implemented similarly to the switches 50 and 50'. The switch 50" includes a non-tactile rubber keypad 56" having a formed key 54" that protrudes through the bezel 52. The pill 58 is fixed to the underside of the key 54". A metal dome 60" is disposed to align with the pill 58 and to provide tactile feel. A spacer 68 having a hole 70 is disposed such that when the switch 50" is actuated, the pill 58 travels through the hole 70 to contact the grid 64. The conventional switch bank 50" has similar deficiencies to the switch 50.

Referring to FIG. 3, a diagram illustrating a conventional switch (or cell) 50'" is shown. The switch 50'" is implemented similarly to the switch 50. The switch 50'" includes a light emitting diode (LED) or other appropriate light source 80 disposed such that the switch 50'" is lighted (i.e., back-lit). The conventional switch 50'" has similar deficiencies to the switch 50 except that the switch 50'" provides lighting.

The conventional switch banks 10, 10', 10", 50, 50', 50", and 50'" have additional deficiencies in that the conventional switch banks are an integrated apparatus or assembly, thus the tactile feel for the switch bank can be difficult to "tune" or adjust to meet the design criteria of a particular application, when the conventional switch banks 10, 10', 10", 50, 50', 50", and 50'" are implemented as a modular package (e.g., having separate integral actuator and switching device assemblies) a "dead zone" can be perceived during switch actuation due to a gap between the actuator and the switching device, the conventional switch banks 10, 10', 10", 50, 50', 50", and 50'" include a relatively large number of components that can be expensive as well as difficult to align properly, the conventional switch banks 10, 10', 10", 50, 50', 50", and 50'" are relatively thick and can be difficult to package in space restrictive installations, and the conventional switch banks 10, 10', 10", 50, 50', 50", and 50'" are generally a rather cumbersome package to install in connection with some applications that have limited room and require efficient use of space such as vehicle switch implementations.

Thus, there exists a need for an improved system and an improved method for a low profile switch with a flat wire harness. The present invention may provide a modular low profile switch package wherein tactile feel can be adjusted to meet the design criteria of a particular application, backlighting may be easily implemented, and the switch may be assembled easily. The low profile switch of the present invention may provide easy installation, and may be implemented with relatively fewer components, with higher system quality and lower system cost when compared to conventional approaches.

SUMMARY OF THE INVENTION

The present invention generally provides new, improved and innovative techniques for a low profile switch with a flat wire harness. The present invention may provide a modular low profile switch package wherein tactile feel can be adjusted to meet the design criteria of a particular application, backlighting may be easily implemented, and the switch may be assembled easily. The low profile switch of the present invention may provide easy installation, and may be implemented with relatively fewer components, with higher system quality and lower system cost when compared to conventional approaches.

According to the present invention, a low profile modular switch is provided. The switch comprising a switch plate comprising an actuator and a housing, and a sense plate comprising a switch mechanism configured to interface with the actuator, and a flat wiring harness having one end joined to the sense plate and another end having a connector, wherein tactile feel of the modular switch is determined by a property of the switch plate independent of the sense plate.

Also according to the present invention, a modular switch bank is provided. The switch bank comprising a switch plate comprising an actuator, and a sense plate comprising a switch mechanism, wherein the switch mechanism is configured to interface with the actuator, and tactile feel of the modular switch bank is determined by a property of the switch plate independent of the sense plate.

Further, according to the present invention, a method of determining tactile feel of a modular switch is provided. The method comprising interfacing a switch plate comprising an actuator, and a sense plate comprising a switch mechanism, wherein the switch mechanism is configured to interface with the actuator, and tactile feel of the modular switch is determined by a property of the switch plate independent of the sense plate.

The above features, and other features and advantages of the present invention are readily apparent from the following detailed descriptions thereof when taken in connection with the accompanying drawings.

BRIEF DESCRIPTION OF THE DRAWINGS

FIGS. 1(*a–c*) are exploded isometric views of conventional switch banks;

FIGS. 2(*a–c*) are exploded, sectional isometric views of other conventional switches;

FIG. 3 is a sectional view of another conventional switch;

FIGS. 6(*a–c*) are diagrams of switch implementations according to the present invention.

DETAILED DESCRIPTION OF THE PREFERRED EMBODIMENT(S)

With reference to the Figures, the preferred embodiments of the present invention will now be described in detail. Generally, the present invention provides an improved system and an improved method for a modular low profile switch with a flat wire harness. The present invention may provide a modular low profile switch package wherein tactile feel can be adjusted to meet the design criteria of a particular application, backlighting may be easily implemented, and the switch may be assembled easily. The low profile switch of the present invention may provide easy installation, and may be implemented with relatively fewer components, with higher system quality and lower system cost when compared to conventional approaches. The modular switch of the present invention generally comprises a switch plate and a sense plate. Tactile feel of the low profile switch of the present invention may be determined by a property of the switch plate independent of the sense plate.

Figure 4:
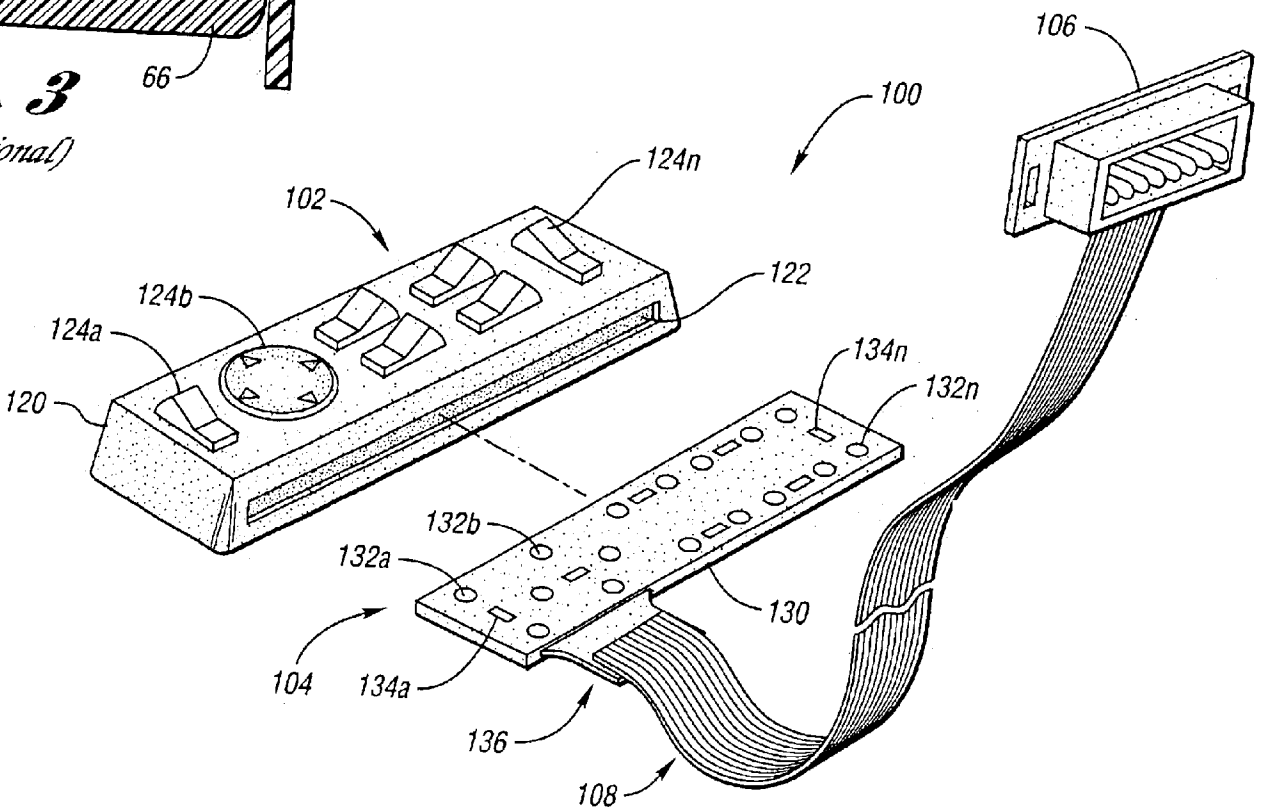
FIG. 4 is a diagram of a switch according to the present invention.

Referring to FIG. 4, a diagram illustrating a switch (or integrated switch bank) 100 according to the present invention is shown. The switch 100 is generally implemented as a low profile modular switch with a flat wire harness. The switch 100 generally comprises a switch plate (or package) 102, a sense plate (or package) 104, a connector 106, and wire harness 108. The switch plate 102 and the sense plate 104 generally are implemented as modular components to the switch 100 (i.e., the switch 100 may be implemented as a modular integrated switch bank). The switch plate 102 is generally configured to operate with (e.g., interface with, be fastened or joined to, etc.) the sense plate 104.

In one example, alternative implementations of the switch plate 102 (described in more detail in connection with FIGS. 5(*a–e*)) may be implemented in connection with the sense plate 104. As such, surface touch and feel, actuation tactile parameters (e.g., feel, sensation, travel, feedback, etc.), visual appearance, audible feedback, ergonomics, human factors, and the like of the switch 100 may be "tuned" (i.e., adjusted, set, controlled, determined, selected, etc.) to meet the design criteria of a particular application. Since the switch 100 may be implemented having "tuning" in the switch plate 102 independent of the sense plate 104, the switch 100 may reduce or eliminate perception of a "dead" zone during actuation that may be present in conventional approaches to modular switches and the switch 100 may have tactile parameters that are implemented to meet the design criteria of a particular application. In one example, the tactile parameters of the switch 100 may be determined through selection or adjustment of the respective properties of the components of the switch plate 102 independent of the sense plate 104 component properties. In another example, the tactile parameters of the switch 100 may be determined through selection or adjustment of the respective properties of the components of the switch plate 102 in connection with the sense plate 104 component properties.

In one example, the switch plate 102 generally comprises a housing 120 that has a slot 122, and at least one actuator (i.e., button, knob, cap, etc.) 124 (e.g., actuators 124*a*–124*n*). The sense plate 104 may be inserted (e.g., positioned, slid, placed, etc.) into the slot 122 to assemble the switch 100. In another example (see, for example, FIGS. 6(*a–c*)), the switch housing 120 may be implemented without the slot 122 and the sense plate 104 may be fastened (or joined) directly to the housing 120 (i.e., to the switch plate 102).

The plate 104 is generally held in place in (or fastened to) the housing 120 using fastening (not shown) such as screws, rivets, clips, formed ridges, and the like. The switch 100 is generally configured such that the plate 104 may be removed from the housing 120 to provide access to the switch plate 102 and the sense plate 104 for servicing, cleaning, etc. In another example, the plate 104 may be fastened to the housing 120 using heat staking, adhesive, welding, riveting, etc. to form a substantially permanent joining of the switch plate 102 and the sense plate 104.

The sense plate 104 generally comprises a membrane (i.e., panel, substrate, plate, etc.) 130 having at least one switching mechanism 132 (e.g., mechanisms 132*a*–132*n*) that are configured to interface electrically and/or mechanically with respective actuators 124*a*–124*n* when the sense plate 104 is assembled into (or aligned with, fastened to, etc.) the switch package 102. When a user pushes, twists, clicks, actuates or otherwise operates an actuator 124, an electrical circuit comprising a respective mechanism 132 and one or more wires in the wire harness 108 is generally completed or opened.

The mechanism 132 may be implemented as a grid, a dome structure, at least one finger spring, at least one wave spring, or any other appropriate apparatus to meet the design criteria of a particular application. In one example, the sense plate 104 may further comprise at least one light source 134 (e.g., light sources 134*a*–134*n*). The light source 134 is generally implemented when the switch 100 is lighted (or backlit). The light source 134 is generally implemented as a light emitting diode (LED), light pipe, fiber optic, luminescent surface device, and the like.

The wire harness 108 generally connects to the sense plate 104 using a splice joint 136 at one end and interfaces to the connector 106 at another end. The joint 136 is generally disposed at an edge of the sense plate 104. The connector 106 is generally connected (i.e., electrically interfaced) to devices (not shown) external to the switch 100 such as motors, control modules, other wire harnesses, etc. In one example, the switch 100 may be implemented without the connector 106 and the wire harness 108 may be directly connected to the devices external to the switch 100. While the wire harness 108 is illustrated as a flat harness, the harness 108 may be implemented having any appropriate shape (e.g., substantially round, oval, rectangular, etc.) to meet the design criteria of a particular application.

Referring to FIGS. 5(*a–e*), detailed sectional diagrams illustrating example embodiments of the switch (or cell) 100 in accordance with the present invention are shown. A number of the switches 100 may be integrated (i.e., combined, configured, implemented as an array, etc.) to provide an integrated switch bank. The switch 100 is generally implemented as an electrical switch. The switch package 100 is generally implemented as a modular switch package comprising at least one implementation of the switch plate (or package) 102, and the sense plate 104.

Figure 5A:
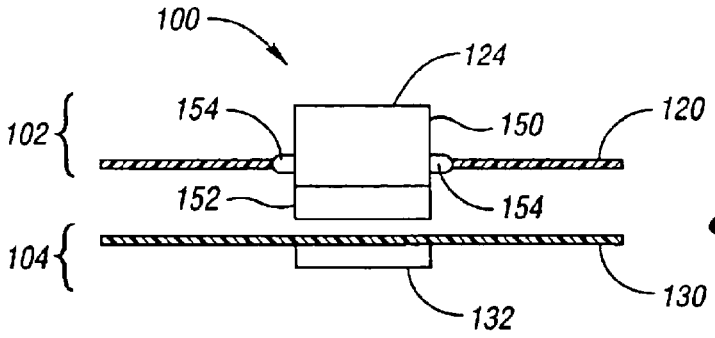
FIGS. 5(*a–e*) are sectional diagrams of switches according to the present invention.

Referring in particular to FIG. 5*a*, a sectional view illustrating an example of the switch 100 is shown. The actuator 124 generally comprises a cap (or knob) 150 affixed to and positioned above a gel pack 152. The actuator 124 is generally held (i.e., mounted, positioned, disposed, etc.) in the housing 120 using a suspension 154. When the user operates (i.e., pushes, actuates, etc.) the cap 124, the gel pack 124 generally contacts the mechanism 132. The suspension 154 may be implemented as molded rubber or elastomer (e.g., a thermoplastic elastomer, TPE), a flexible foam material such as a urethane foam, and the like. The suspension 154 is generally implemented as a low compliance suspension. The suspension 154 may provide sealing between the housing 120 and the actuator 124. In one example, the cap 150 may be implemented using a molded hard plastic. In another example, the cap 150 may be implemented using a molded soft plastic, rubber, TPE and the like.

The gel pack 152 may be implemented having an appropriate thickness, and filled with a gel having an appropriate compliance to meet the touch and feel design criteria or parameters of a particular application. In one example, the tactile parameters of the switch 100 as illustrated in FIG. 5*a* may be adjusted by appropriate implementation of properties (e.g., material, thickness, etc.) of the cap 150, the gel pack 152, and the suspension 154 such as compliance, stiffness, flexibility, etc. in connection with the mechanism 132. In another example, the tactile parameters of the switch 100 may be adjusted by appropriate implementation of properties of the cap 150, the gel pack 152, and the suspension 154 such as compliance, stiffness, flexibility, etc. independent of the mechanism 132.

Figure 5B:
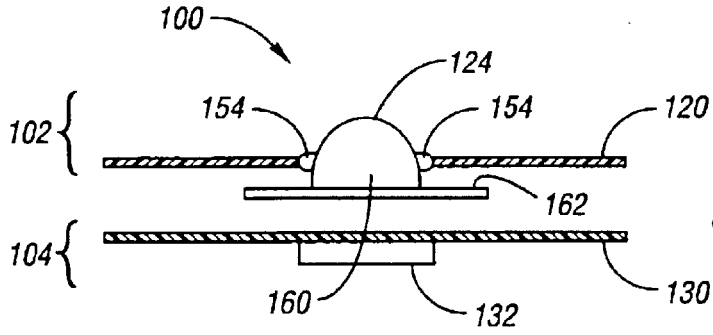

Referring in particular to FIG. 5*b*, a sectional view illustrating another example of the switch 100 is shown. The actuator 124 generally comprises a sealed sac (e.g., vessel, bag, pouch, etc.) that may be filled with a filler 160, and a subplate 162. In one example, the filler 160 may be implemented as a liquid. In another example, the filler 160 may be implemented as a gel. In another example, the filler 160 may be implemented as a gas. However, the filler 160 may be implemented as any appropriate material to meet the design criteria of a particular application. The subplate 162 may provide a rigid (i.e., stiff, noncompliant, etc.) surface that contacts and actuates the mechanism 132 when a user operates the switch 100. The tactile parameters of the switch 100 as illustrated in FIG. 5*b* may be adjusted by appropriate implementation of properties of the sac 124, the suspension 154, and the filler 160 such as compliance, stiffness, flexibility, etc. in connection with the mechanism 132. In another example, the tactile parameters of the switch 100 may be determined independent of the mechanism 132.

Figure 5C:
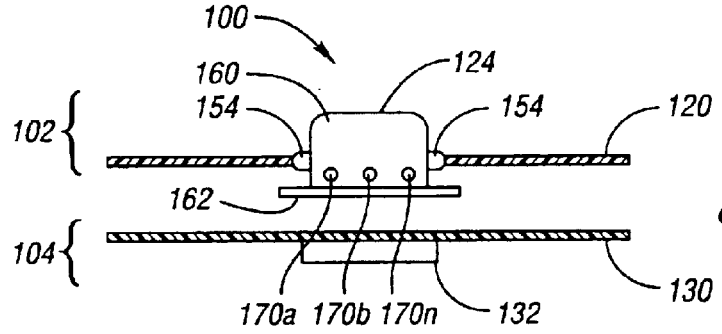

Referring in particular to FIG. 5*c*, a sectional view illustrating another example of the switch 100 is shown. The actuator 124 generally comprises a vented sac (e.g., vessel, bag, pouch, etc.). The filler 160 may be implemented as air. The sac (i.e., actuator) 124 further comprises at least one vent 170 (e.g., vents 170*a*–170*n*). When the switch 100 is operated, the air 160 is generally exhausted from the sac 124 through the at least one vent 170. When the switch 100 is released, the air 160 is generally inlet to the sac 124 through the at least one vent 170. The tactile parameters of the switch 100 as illustrated in FIG. 5*c* may be adjusted by appropriate implementation (e.g., number of, size of, etc.) of the at least one vent 170, properties of the sac 124 and the suspension 154 such as compliance, stiffness, flexibility, etc. in connection with the mechanism 132. In another example, the tactile parameters of the switch 100 may be determined independent of the mechanism 132.

Figure 5D:
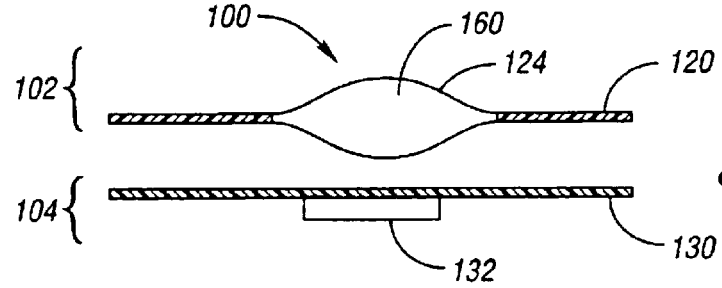

Referring in particular to FIG. 5*d*, a sectional view illustrating another example of the switch 100 is shown. The actuator 124 generally comprises a sealed sac having a filler 160. The sac 124 and the filler 160 may be implemented similar to the respective sac 124 and filler 160 of the switch 100 illustrated in FIG. 5*b*. However, the switch 100 as illustrated in FIG. 5*d* may be implemented without the suspension 154 and the subplate 162. The sac 124 may be connected (e.g., mounted, fastened, adhered, welded, etc.) directly to the housing 120. The sac 124 may directly contact the mechanism 132 when the switch 100 is operated. In one example, the tactile parameters of the switch 100 may be determined through selection or adjustment of properties of the sac 100, the filler 160 such as compliance stiffness, flexibility, etc., and the mechanism 132. In another example, the tactile parameters of the switch 100 may be determined independent of the mechanism 132.

Figure 5E:
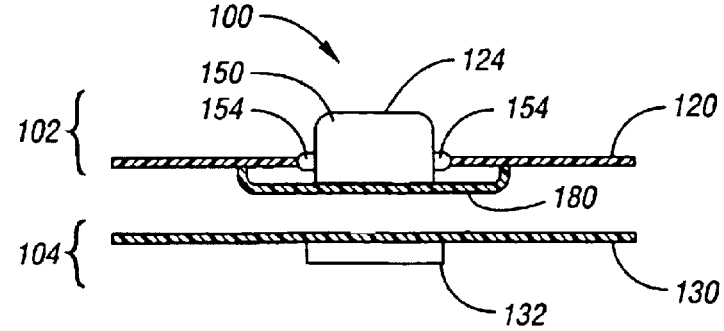

Referring in particular to FIG. 5*e*, a sectional view illustrating another example of the switch 100 is shown. The switch 100 may be implemented similarly to the switch 100 illustrated in FIG. 5*a*. The switch 100 may further comprise a button suspension 180. The button suspension 180 is generally implemented to proved supplemental suspension for the actuator 124 in addition to the suspension 154. However, in another example (not shown), the suspension 154 may be deleted and the button suspension 180 may provide the suspension for the actuator (i.e., button, cap, etc.) 124. In any case, the properties of the suspension 180 such as compliance, stiffness, flexibility, etc. may be implemented or adjusted to provide tactile parameters for the switch 100 in connection with the suspension 154 (when implemented) and the mechanism 132. In another example, the tactile parameters of the switch 100 may be determined independent of the mechanism 132.

Referring to FIGS. 6(*a*–*c*) diagrams 200 illustrating example applications of the switch 100 in connection with a vehicle interior are shown. Referring to FIG. 6*a*, a door trim panel 202 may have an arm rest 204 where the switch 100 is installed. Referring to FIG. 6*b*, an instrument panel 210 may have a center stack region 212 where the switch 100 is installed. Referring to FIG. 6*c*, the switch 100 may be installed in a console 220. As illustrated in FIGS. 6(*a*–*c*) the switch 100 may be advantageously implemented in connection with vehicle interior applications such as the door trim panel 202, the instrument panel 210, and the console 220 when compared to conventional switch approaches since the switch 100 is a low profile modular switch package with a flat wiring harness. The switch plate 102 and the sense plate 104 (and the connector 106 and the wire harness 108) may be installed in separate operations and then joined to assemble the switch 100. As such, installation of the switch 100 may more easily be performed when compared to more cumbersome and thick conventional switch approaches.

As is readily apparent from the foregoing description, then, the present invention generally provides an improved apparatus (e.g., the switch 100) and/or an improved method for a modular low profile switch bank package. The present invention may provide a modular low profile switch package wherein tactile feel can be adjusted to meet the design criteria of a particular application, backlighting may be easily implemented, and the switch may be assembled easily. The low profile switch of the present invention may provide easy installation, and may be implemented with relatively fewer components, with higher system quality and lower system cost when compared to conventional approaches.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A low profile modular switch, the switch comprising:

a switch plate comprising an actuator and a housing; and a sense plate comprising a switch mechanism configured to interface with the actuator, and a flat wiring harness having one end joined to the sense plate and another end having a connector, wherein tactile feel of the modular switch is determined by a property of the switch plate independent of the sense plate, the actuator is mounted to the housing using a suspension, and the actuator comprises a vented sac and a subplate.

2. The modular switch of claim 1 wherein the switch plate tactile feel property comprises at least one of actuator and suspension compliance, stiffness, and flexibility.

3. The modular switch of claim 1 wherein the wiring harness is joined to an edge of the sense plate.

4. The modular switch of claim 1 wherein the sense plate further comprises a light source disposed to light the actuator.

5. A modular switch bank comprising:

a switch plate comprising an actuator;

a sense plate comprising a switch mechanism, wherein the switch mechanism is configured to interface with the actuator, and tactile feel of the modular switch bank is determined by a property of the switch plate independent of the sense plate; and a housing, wherein the actuator comprises a vented sac and a subplate, and the actuator is mounted to the housing using a suspension.

6. The switch bank of claim 5 wherein the switch plate tactile feel property comprises at least one of actuator and suspension compliance, stiffness, and flexibility.

7. A method of determining tactile feel of a modular switch, the method comprising:

interfacing a switch plate comprising an actuator, a sense plate comprising a switch mechanism, and a housing, wherein the at least one actuator comprises a vented sac and a subplate, and the at least one actuator is mounted to the housing using a suspension, and wherein the switch mechanism is configured to interface with the actuator, and tactile feel of the modular switch is determined by a property of the switch plate independent of the sense plate.

8. The method of claim 7 wherein the switch plate tactile feel property comprises at least one of actuator and suspension compliance, stiffness, and flexibility.

9. The method of claim 7 further comprising joining a wiring harness to an edge of the sense plate.

10. The method of claim 7 further comprising disposing a light source to light the actuator.

* * * * *